US009981179B1

(12) United States Patent
Matthews et al.

(10) Patent No.: US 9,981,179 B1
(45) Date of Patent: May 29, 2018

(54) PRIZE WHEEL ASSEMBLY

(71) Applicant: SIGN-ZONE, INC., Ramsey, MN (US)

(72) Inventors: Patrick T. Matthews, Ramsey, MN (US); Michael B. Younes, Ramsey, MN (US)

( * ) Notice: Subject to any disclaimer, the term of this patent is extended or adjusted under 35 U.S.C. 154(b) by 5 days.

(21) Appl. No.: 15/289,182

(22) Filed: Oct. 9, 2016

(51) Int. Cl.
*A63B 71/00* (2006.01)
*A63F 5/04* (2006.01)

(52) U.S. Cl.
CPC ..... *A63F 5/045* (2013.01)

(58) Field of Classification Search
CPC ..... A63B 71/00; A63F 1/18
USPC ..... 273/142 R
See application file for complete search history.

(56) References Cited

U.S. PATENT DOCUMENTS 105,468 A * 7/1870 Marais ..... A63F 5/04 273/142 F
130,234 A * 8/1872 Murray ..... A63F 5/04 273/142 F
285,357 A * 9/1883 Hamill ..... A63F 5/045 273/142 JA
444,176 A * 1/1891 Leslie ..... A43B 3/166 36/70 R
1,167,407 A * 1/1916 Johnson ..... 273/141 R
1,557,788 A * 10/1925 Atkin ..... A63F 9/0208 273/338
2,025,942 A * 12/1935 Dunwoody ..... A63F 5/04 273/141 R
2,282,285 A * 5/1942 Olson ..... F16M 11/046 16/24
2,618,484 A * 11/1952 Bishop ..... F41J 3/0019 248/455
2,626,155 A * 1/1953 Beierle ..... A63F 7/0608 273/143 R
3,141,674 A * 7/1964 Hoffman ..... G07C 15/00 273/142 R
3,263,347 A * 8/1966 McCutcheon ..... G09B 1/00 211/50
3,841,637 A * 10/1974 Piazza ..... A63F 1/14 273/141 A
4,227,341 A * 10/1980 Kaul, Jr. ..... A63H 33/02 273/337
4,813,676 A * 3/1989 Weatherspoon ..... A63F 7/048 273/144 A
5,184,821 A * 2/1993 Korenek ..... A63F 5/04 273/138.2
6,705,944 B2 * 3/2004 Luciano ..... G07F 17/32 273/143 R
7,604,207 B2 * 10/2009 Hasloecher ..... F16M 11/42 16/32
7,669,853 B2 * 3/2010 Jones ..... A63F 1/12 273/142 JA
8,197,327 B2 * 6/2012 Barton ..... G07F 17/32 463/16
2013/0307216 A1 * 11/2013 Jones ..... A63F 1/12 273/149 R (Continued)

*Primary Examiner* — John E Simms, Jr.
*Assistant Examiner* — Dolores Collins
(74) *Attorney, Agent, or Firm* — Dave Alan Lingbeck

(57) ABSTRACT

A prize wheel assembly for facilitating interchanging the prize designations on the prize wheel. The prize wheel assembly includes a stand assembly; a display support assembly including a wheel member removably mounted to the stand assembly; and a signage support assembly removably mounted to the stand assembly.

14 Claims, 2 Drawing Sheets

(56) References Cited

U.S. PATENT DOCUMENTS

2015/0011285 A1* 1/2015 Kaiblinger ..... A63F 5/045
463/16

* cited by examiner

PRIZE WHEEL ASSEMBLY

BACKGROUND OF THE INVENTION

Field of the Invention

The present invention relates to prize wheels and more particularly pertains to a new prize wheel assembly for facilitating interchanging the prize designations on the prize wheel.

Description of the Prior Art

The use of prize wheels is known in the prior art. More specifically, prize wheels heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a sheet mechanically attached above the surface of a base such that prize or other selection references can be positioned and displayed at different selectable locations on the device. The sheet may mechanically attach above the surface of the base by interacting with the base at a plurality of locations on the base. The sheet may mechanically interact with, for example, radially-oriented ribs projecting in wheel spoke-like locations above the surface of the base. Paper or cards placed between such ribs and also between the base and clear sheet may display information about individual selectable items that are won or otherwise selected based on a spin of the wheel. While this device fulfills its respective, particular objectives and requirements, the aforementioned patent does not disclose a new prize wheel assembly.

SUMMARY OF THE INVENTION

The general facilitating interchanging the display members on the prize wheel of the present invention, which will be described subsequently in greater detail, is to provide a new prize wheel assembly which has many of the advantages of the prize wheels mentioned heretofore and many novel features that result in a new prize wheel assembly which is not anticipated, rendered obvious, suggested, or even implied by any of the prior art prize wheels, either alone or in any combination thereof. The present invention includes a stand assembly; a display support assembly including a wheel member removably mounted to the stand assembly; and a signage support assembly removably mounted to the stand assembly. None of the prior art includes the combination of the elements of the present invention.

There has thus been outlined, rather broadly, the more important features of the prize wheel assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the facilitating interchanging the display members on the prize wheel of description and should not be regarded as limiting.

It is an object of the present invention to provide a new prize wheel assembly which has many of the advantages of the prize wheels mentioned heretofore and many novel features that result in a new prize wheel assembly which is not anticipated, rendered obvious, suggested, or even implied by any of the prior art prize wheels, either alone or in any combination thereof.

Still another object of the present invention is to provide a new prize wheel assembly for facilitating interchanging the prize designations on the wheel member.

Still yet another object of the present invention is to provide a new prize wheel assembly that easily and conveniently displays signs and messages on the prize wheel assembly.

Even still another object of the present invention is to provide a new prize wheel assembly that uses an entire sheet with various prize designations displayed thereon instead of using individual cards with one prize designation displayed thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
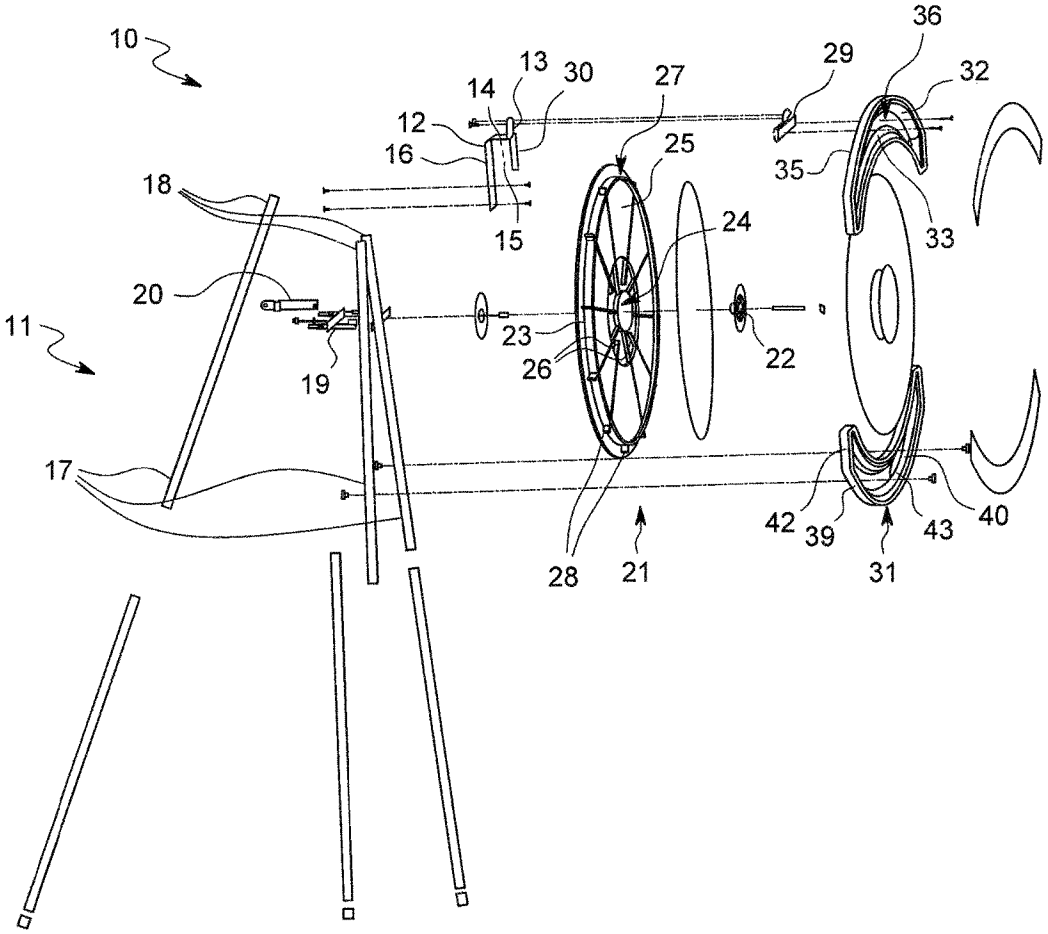
FIG. 1 is an exploded perspective view of a new prize wheel assembly according to the present invention.
Figure 3:
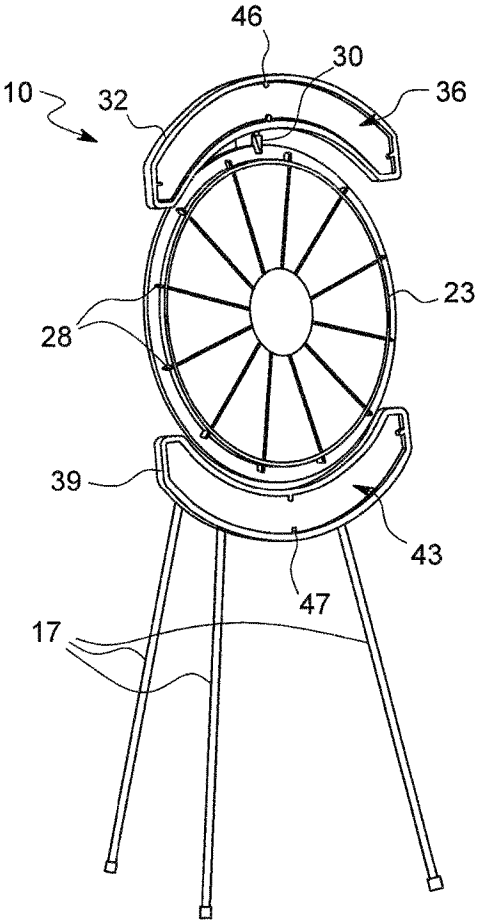
FIG. 3 is a rear perspective view of the present invention.
Figure 2:
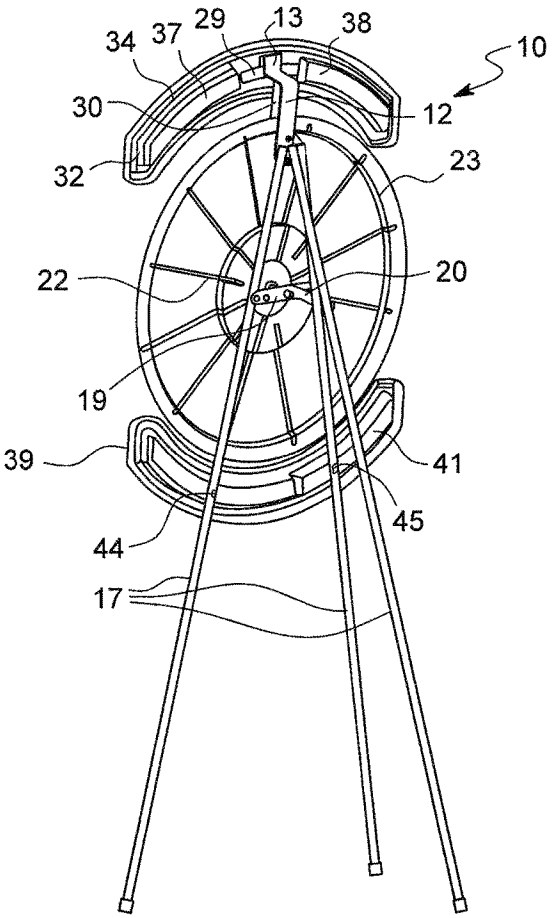
FIG. 2 is a front perspective view of the present invention.

With reference now to the drawings, and in particular to FIGS. 1 through 3 thereof, a new prize wheel assembly embodying the principles and concepts of the present invention and generally designated by the reference numeral 10 will be described.

As best illustrated in FIGS. 1 through 3, the prize wheel assembly 10 may generally comprise a stand assembly 11; a display support assembly 21 including a wheel member 23 removably and conventionally mounted to the stand assembly 11; and a signage support assembly 31 removably mounted to the stand assembly 11. The stand assembly 11 may include a support bracket 12 and legs 17 each having a top end 18 pivotably and conventionally fastened to the support bracket 12. The stand assembly 11 may also include braces 19, 20 conventionally fastened to and interconnecting and securely spatially positioning the legs 18 relative to one another to form a tripod when set up. The braces 19, 20 may include a first brace 19 conventionally fastened to and interconnecting at least two of the legs 17, and may also include a second brace 20 conventionally fastened to the first brace 19 and extending therefrom and conventionally fastened to another one of the legs 17. The support bracket 12 may include a top portion 13, an intermediate portion 14 angled approximately 90 degrees relative to the top portion 13 with a bottom side 15, and a bottom portion 16 angled approximately 90 degrees to the intermediate portion 14 and disposed approximately parallel relative to the top portion 13. The stand assembly 11 may further include an inverted U-shaped connector 29 conventionally depending from the bottom side 15 the intermediate portion 14 of the support bracket 12.

As shown in FIGS. 2 and 3, the display support assembly 21 may include a wheel support member 22 removably mounted to the first brace 19 with the wheel member 23 rotatably and conventionally mounted to the wheel support member 22. The wheel member 23 may be disc-shaped and may have an opening 24 centrally disposed therethrough with the wheel support member 22 removably disposed in the opening 24. The wheel member 23 may also have a front side 25 with a circumferential recess 27 disposed therein. The wheel member 23 may further have finger-like structures 26 integrally and conventionally disposed upon and along the front side 25 and extending radially from the opening 24 for supporting a display sheet. The wheel member 23 may further include pegs 28 conventionally disposed in the circumferential recess 27 and circumferentially spaced about and extending outwardly from the front side 25 of the wheel member 23. The display support assembly 21 may further include a flexible elongate finger 30 conventionally fastened to the inverted U-shaped connector 29 and depending therefrom and in contactable relationship with the pegs 28 when the prize wheel assembly 10 is set up.

As illustrated in FIGS. 1 through 3, the signage support assembly 31 may include signage support members 32, 39 which are rigid arcuate narrow strips of material each having a front side 33, 40 and a frame 35, 42 conventionally and integrally disposed along a perimeter thereof and forming a recessed area 36, 43 within the frame 35, 42 on the front side 33, 40 for supporting a sign thereon and also including tabs 46, 47 conventionally disposed in the recessed area 36, 43 to retain the sign. The signage support members 32, 39 may include a first signage support member 32 removably disposed in a downwardly quarterly circular arc above and in planar alignment with the wheel member 23 and mounted to the support bracket 12. The first signage support member 32 may have a back side 34 with guide members 37, 38 conventionally disposed upon the back side 34 and spaced apart. The top portion 13 of the support bracket 12 may be removably and conventionally fastened to the back side 34 of the first signage support member 32. The top portion 13 of the support bracket 12 may be removably disposed between the guide members 37, 38. The signage support members 32, 39 may also include a second signage support member 39 removably disposed in an upwardly quarterly circular arc below and in planar alignment with the wheel member 23 and removably engaged with the stand assembly 11. The second signage support member 39 may have a back side 41 with fasteners 44, 45 conventionally extending from the back side 41 of the second signage support member 39 and removably clipped about at least two of the legs 17.

In use, the user places a display sheet upon the front side 25 of the wheel member 23 with the finger-like structures 26 received through slots of the display sheet to retain the display sheet to the wheel member 23. The user also can insert separate signs in the recessed areas 36, 43 of the signage support members 32, 39. The display sheet may have different designations arranged in wedge shapes on the display sheet. A player can spin the wheel member 23 and can claim the prize to which the flexible finger 30 points to one of the designations upon the wheel member 23 stopping. The user can quickly interchange the designations by removing the display sheet and putting another display sheet on the wheel member 23.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the prize wheel assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A prize wheel assembly comprising:

a stand assembly including a support bracket and legs each having a top end pivotably attached to the support bracket wherein the stand assembly also includes braces interconnecting and securely spatially positioning the legs relative to one another to form a tripod when set up, wherein the braces include a first brace interconnecting at least two of the legs, and also includes a second brace fastened to the first brace and extending therefrom and fastened to another one of the legs;

a display support assembly including a wheel member removably mounted to the stand assembly, wherein the display support assembly includes a wheel support member removably mounted to the first brace with the wheel member rotatably mounted to the wheel support member; and a signage support assembly removably mounted to the stand assembly.

2. The prize wheel assembly as described in claim 1, wherein the wheel member is disc-shaped and has an opening centrally disposed therethrough with the wheel support member removably disposed in the opening, and the wheel member also has a front side with a circumferential recess disposed therein.

3. The prize wheel assembly as described in claim 2, wherein the wheel member further has finger-like structures disposed upon and along the front side and extending radially from the opening for supporting a display sheet.

4. The prize wheel assembly as described in claim 2, wherein the wheel member further includes pegs disposed in the circumferential recess and circumferentially spaced about and extending outwardly from the front side of the wheel member.

5. A prize wheel assembly comprising:

a stand assembly which includes a support bracket and legs each having a top end pivotably attached to the support bracket, wherein the support bracket includes a top portion, an intermediate portion angled approximately 90 degrees relative to the top portion with a bottom side, and a bottom portion angled approximately 90 degrees to the intermediate portion and disposed approximately parallel relative to the top portion;

a display support assembly including a wheel member removably mounted to the stand assembly; and a signage support assembly removably mounted to the stand assembly.

6. The prize wheel assembly as described in claim 5, wherein the stand assembly further includes an inverted U-shaped connector depending from the bottom side the intermediate portion of the support bracket.

7. The prize wheel assembly as described in claim 6, wherein the display support assembly further includes a flexible finger fastened to the inverted U-shaped connector and depending therefrom and in contactable relationship with the pegs when the prize wheel assembly is set up.

8. The prize wheel assembly as described in claim 5, wherein the signage support assembly includes signage support members which are rigid arcuate narrow strips of material each having a front side and a frame disposed along a perimeter thereof and forming a recessed area within the frame on the front side for supporting a sign thereon and also including tabs in the recessed area for retaining the sign.

9. The prize wheel assembly as described in claim 8, wherein the signage support members include a first signage support member removably disposed in a downwardly quarterly circular arc above and in planar alignment with the wheel member and mounted to the support bracket.

10. The prize wheel assembly as described in claim 8, wherein the signage support members also includes a second signage support member removably disposed in an upwardly quarterly circular arc below and in planar alignment with the wheel member and removably engaged with the stand assembly.

11. The prize wheel assembly as described in claim 10, wherein the second signage support member has a back side with fasteners extending from the back side of the second signage support member and removably clipped about at least two of the legs.

12. The prize wheel assembly as described in claim 9, wherein the first signage support member has a back side with guide members disposed upon the back side and spaced apart.

13. The prize wheel assembly as described in claim 12, wherein the top portion of the support bracket is removably fastened to the back side of the first signage support member.

14. The prize wheel assembly as described in claim 13, wherein the top portion of the support bracket is removably disposed between the guide members.

* * * * *